US011371455B2

(12) United States Patent
Moine et al.

(10) Patent No.: US 11,371,455 B2
(45) Date of Patent: Jun. 28, 2022

(54) METHOD FOR CONTROLLING AN AIR-COOLED INTERNAL COMBUSTION ENGINE

(71) Applicant: VITESCO TECHNOLOGIES GMBH, Hannover (DE)

(72) Inventors: Xavier Moine, Toulouse (FR); Antoine Benne, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/278,961

(22) PCT Filed: Sep. 16, 2019

(86) PCT No.: PCT/EP2019/074622
§ 371 (c)(1),
(2) Date: Mar. 23, 2021

(87) PCT Pub. No.: WO2020/064383
PCT Pub. Date: Apr. 2, 2020

(65) Prior Publication Data

US 2022/0049667 A1 Feb. 17, 2022

(30) Foreign Application Priority Data

Sep. 24, 2018 (FR) ..... 1858628

(51) Int. Cl.
*F02D 41/14* (2006.01)

(52) U.S. Cl.
CPC .. *F02D 41/1406* (2013.01); *F02D 2041/1432* (2013.01); *F02D 2041/1433* (2013.01);
(Continued)

(58) Field of Classification Search
CPC ..... F02D 41/1406; F02D 2041/1432; F02D 2041/1433; F02D 2200/022; F02D 2200/0414
(Continued)

(56) References Cited

U.S. PATENT DOCUMENTS 9,644,558 B2 5/2017 Dangelmaier et al.
2012/0271606 A1* 10/2012 Yeh ..... F02D 41/065 703/7
(Continued)

FOREIGN PATENT DOCUMENTS

DE 100 01 713 A1 7/2001
DE 10 2005 030 535 A1 1/2007
(Continued)

OTHER PUBLICATIONS

International Search Report and Written Opinion of the ISA for PCT/EP2019/074622 dated Oct. 14, 2019, 10 pages.

*Primary Examiner* — Erick R Solis
(74) *Attorney, Agent, or Firm* — Nixon & Vanderhye

(57) ABSTRACT

A method for controlling an air-cooled internal combustion engine (ICE) of a motor vehicle controlled by an electronic control unit, includes: activating the electronic control unit; zeroing stored values of temperature of the ICE and the filtered filtering coefficient; in one iteration, —determining whether the ICE is operating, determining a filtering coefficient and a temperature setpoint, —determining a filtered filtering coefficient based on the filtering coefficient and the stored filtered filtering coefficient value, —determining temperature of the ICE according to the coefficient, temperature setpoint and stored temperature of the ICE, —determining whether the ICE is moving and whether the difference between engine temperature and admitted air temperature is below a threshold, • if not, storing the filtered filtering coefficient and the temperature of the ICE, then beginning a
(Continued)

new iteration, and • if so, transmitting a signal authorizing the shutdown of the electronic control unit.

6 Claims, 1 Drawing Sheet

(52) U.S. Cl.
CPC ..... *F02D 2200/022* (2013.01); *F02D 2200/0414* (2013.01); *F02D 2200/101* (2013.01)

(58) Field of Classification Search
USPC ..... 701/101
See application file for complete search history.

(56) References Cited

U.S. PATENT DOCUMENTS

| | | | | |
|---|---|---|---|---|
| 2017/0122240 | A1* | 5/2017 | Burkhardt | F02D 41/1401 |
| 2018/0118361 | A1 | 5/2018 | Choi et al. | |
| 2019/0040836 | A1* | 2/2019 | Toyama | F02P 5/15 |
| 2019/0063343 | A1* | 2/2019 | Eser | F02D 41/40 |
| 2020/0370493 | A1* | 11/2020 | Sasaki | F02D 41/064 |

FOREIGN PATENT DOCUMENTS

| | | | |
|---|---|---|---|
| DE | 10 2008 027 763 | A1 | 12/2009 |
| DE | 10 2014 000 467 | | 7/2015 |
| WO | 2014/171491 | | 10/2014 |

* cited by examiner

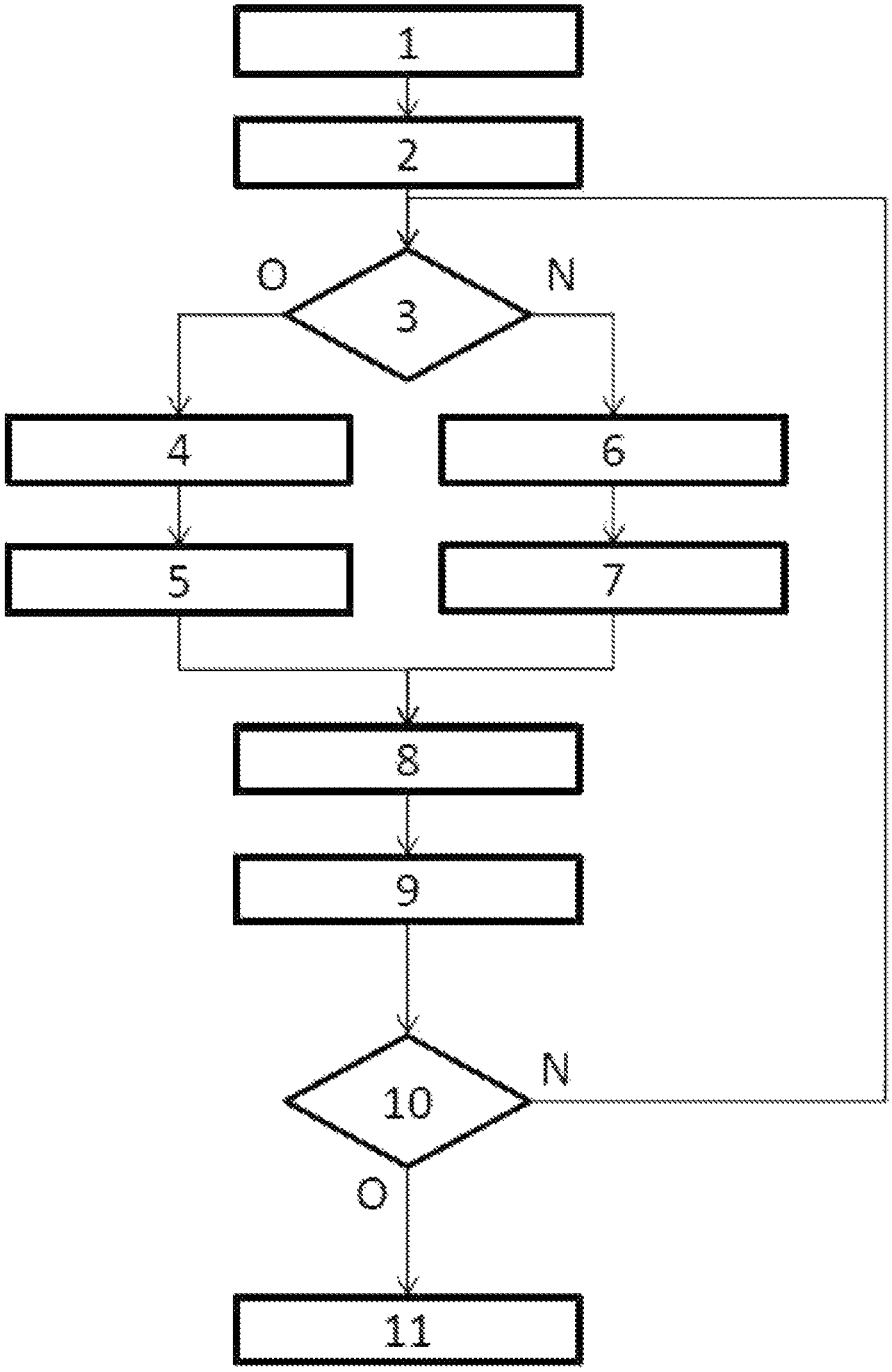
1
2
O
3
N
4
6
5
7
8
9
10
N
O
11

METHOD FOR CONTROLLING AN AIR-COOLED INTERNAL COMBUSTION ENGINE

This application is the U.S. national phase of International Application No. PCT/EP2019/074622 filed Sep. 16, 2019 which designated the U.S. and claims priority to FR Patent Application No. 1858628 filed Sep. 24, 2018, the entire contents of each of which are hereby incorporated by reference.

BACKGROUND OF THE INVENTION

Field of the Invention

The technical field of the invention is that of air-cooled internal combustion engines and, more particularly, controlling such engines.

DESCRIPTION OF THE RELATED ART

The systems for controlling an internal combustion engine require information relating to the temperature of the engine in order to control injection correctly, in particular for the cold-start and warm-up phases.

A specific sensor is used to measure the temperature of the cylinder head in the case of air-cooled internal combustion engines. The temperature of the cylinder head is assumed to be representative of the temperature of the engine due to its location close to the combustion zone.

For certain applications of an air-cooled internal combustion engine provided with a carburetor, the cylinder head is not suitable for the installation of a temperature sensor, in particular in the case of conversion of the injection system.

There is therefore a need for a method for controlling such an internal combustion engine without a temperature sensor on the cylinder head or in the engine.

SUMMARY OF THE INVENTION

The subject of the invention is a method for controlling an air-cooled internal combustion engine of a motor vehicle controlled by an electronic control unit provided with means for determining the temperature of the air admitted, comprising the following steps:

the electronic control unit is activated;

a stored value of the temperature of the internal combustion engine is set to a value equal to the admitted-air temperature and a stored value of a filtered filtering coefficient is set to a value of zero;

in one iteration, the following steps are carried out:

- it is determined whether the internal combustion engine is in operation, a filtering coefficient is determined according to the operating state of the internal combustion engine and a temperature setpoint is next determined according to the operating state of the internal combustion engine;
- a filtered filtering coefficient is determined by first-order-filtering the filtering coefficient according to the stored value of the filtered filtering coefficient;
- a temperature of the internal combustion engine is determined according to the filtered filtering coefficient, according to the temperature setpoint and according to the stored value of the temperature of the internal combustion engine;
- it is determined whether the internal combustion engine is at a standstill and whether the difference between the temperature of the engine and the temperature of the air admitted is below a predetermined threshold,
- if such is not the case, the filtered filtering coefficient and the temperature of the internal combustion engine are stored, then the method returns to determining the operation of the internal combustion engine in a new iteration,
- if such is the case, a signal authorizing the shutdown of the electronic control unit is transmitted.

When the internal combustion engine is in operation, a filtering coefficient may be determined on the basis of a first stored map according to the rotational speed of and according to the load on the internal combustion engine, next, a temperature setpoint may be determined on the basis of a second stored map according to the rotational speed of and according to the load on the internal combustion engine, the load being the mass of air admitted or the torque at the output of the main shaft.

When the internal combustion engine is not in operation, a filtering coefficient may be determined according to a predetermined value, and a temperature setpoint may next be determined so as to be equal to the temperature of the air admitted.

Such a control method has the advantage of not requiring the engine to be modified in order to implement a temperature sensor.

The control method may continue to monitor the temperature of the cylinder head for a predetermined period after the vehicle has come to a standstill in order to have an accurate value for the temperature of the cylinder head in the case of a hot start.

BRIEF DESCRIPTION OF THE DRAWING

Other objects, features and advantages of the invention will become apparent from reading the following description, given solely by way of nonlimiting example and made with reference to the attached drawing in which:

the sole FIGURE illustrates the main steps in a method for controlling an internal combustion engine according to the invention.

DESCRIPTION OF THE PREFERRED EMBODIMENTS

Air-cooled internal combustion engines exhibit fast thermal-variation kinetics making them good candidates for estimating the cylinder temperature by modeling.

In the sole FIGURE, it is possible to see the main steps in a method for controlling an air-cooled internal combustion engine according to the invention.

In a first step 1, the electronic control unit of the vehicle is activated. The activation may be due to a startup request from the driver or due to the power supply of the vehicle being switched without a startup request from the driver.

In a second step 2, a stored value of the temperature of the engine $EGT_{n-1}$ is set to a value equal to the admitted-air temperature and a stored value of the filtered filtering coefficient is set to a value of zero. It is in particular advantageous to determine this temperature at the site of the cool-air intake butterfly valve, said intake butterfly valve generally being fitted with a pressure sensor and with a sensor for the admitted-air temperature.

In one iteration, the following steps are carried out.

In a third step 3, it is determined whether the internal combustion engine is in operation. To achieve this, it is determined whether a rotational speed of the main output shaft is nonzero.

If such is the case, the method continues with a fourth step 4 in which it is determined whether the state of the internal combustion engine has changed. If such is the case, the stored value of the filtered filtering coefficient FLT_FLT is set to the value of zero. If such is not the case, the stored value of the filtered filtering coefficient is retained. In the same step, a filtering coefficient FLT is determined on the basis of a first stored map according to the rotational speed of and according to the load on the internal combustion engine. The term "load" is understood to mean the mass of air admitted or the torque at the output of the main shaft.

In a fifth step 5, a temperature setpoint EGT_S is next determined on the basis of a second stored map according to the rotational speed of and according to the load on the internal combustion engine. The second map is an asymptotic map.

If it is determined that the internal combustion engine is not in operation in the third step 3, the method continues with a sixth step 6 in which it is determined whether the state of the internal combustion engine has changed. If such is the case, the stored value of the filtered filtering coefficient FLT_FLT is set to the value of zero. If such is not the case, the stored value of the filtered filtering coefficient is retained. In the same step, a filtering coefficient FLT is determined according to a predetermined value.

In a seventh step 7, a temperature setpoint EGT_SP is next determined so as to be equal to the temperature of the air admitted.

Upon completion of step 5 or step 7, the method continues with an eighth step 8 in which a filtered filtering coefficient is determined by first-order-filtering the filtering coefficient according to the stored value of the filtered filtering coefficient. The purpose of filtering the filtering coefficient is to model the effects of thermal inertia during transitions between the engine being at a standstill and in operation. The stored value of the filtered filtering coefficient is the value stored after activation of the electronic control unit in the first iteration, or the stored value of the filtered filtering coefficient determined in the preceding iteration for the other iterations.

In a ninth step 9, the temperature of the internal combustion engine $EGT_n$ is determined according to the filtered filtering coefficient FLT_FLT, according to the temperature setpoint EGT_SP and according to the stored value of the temperature of the internal combustion engine $EGT_{n-1}$ by applying the following equation Eq. 1:

$$EGT_n = EGT_{n-1} + FLT_FLT(EGT_SP - EGT_{n-1}) \quad (Eq.\ 1)$$

In other words, the variation in temperature between two instances of the temperature of the internal combustion engine is determined by first-order-filtering the difference in temperature between the temperature setpoint and the stored value of the temperature according to the filtered filtering coefficient. The stored value of the temperature of the internal combustion engine is the value stored after activation of the electronic control unit in the first iteration, or the stored value of the temperature of the internal combustion engine determined in the preceding iteration for the other iterations.

In a tenth step 10, it is determined whether the internal combustion engine is at a standstill and whether the difference between the temperature of the engine and the temperature of the air admitted is below a predetermined threshold.

If such is the case, the method continues with an eleventh step 11 in which the electronic control unit is ordered to shut down. Alternatively, a signal authorizing the shutdown of the electronic control unit in relation to the engine temperature is transmitted. This authorization signal is considered together with the other signals authorizing shutdown for the actual execution of shutdown, which is generally referred to by the term "powerlatch".

If such is not the case, the filtered filtering coefficient and the temperature of the internal combustion engine are stored, then the method returns to the third step 3 in a new iteration.

The invention claimed is:

1. A method for controlling an air-cooled internal combustion engine of a motor vehicle controlled by an electronic control unit provided with means for determining the temperature of the air admitted, comprising the following steps:

the electronic control unit (1) is activated;

a stored value of the temperature of the internal combustion engine is set (2) to a value equal to the admitted-air temperature and a stored value of a filtered filtering coefficient is set to a value of zero, in one iteration, the following steps are carried out:

it is determined (3) whether the internal combustion engine is in operation, a filtering coefficient is determined (4) according to the operating state of the internal combustion engine and a temperature setpoint is next determined (5) according to the operating state of the internal combustion engine;

a filtered filtering coefficient is determined (8) by first-order-filtering the filtering coefficient according to the stored value of the filtered filtering coefficient;

a temperature of the internal combustion engine is determined (9) according to the filtered filtering coefficient, according to the temperature setpoint and according to the stored value of the temperature of the internal combustion engine;

it is determined (10) whether the internal combustion engine is at a standstill and whether the difference between the temperature of the engine and the temperature of the air admitted is below a predetermined threshold, if such is not the case, the filtered filtering coefficient and the temperature of the internal combustion engine are stored, then the method returns to determining (3) the operation of the internal combustion engine in a new iteration, if such is the case, a signal authorizing the shutdown of the electronic control unit is transmitted (11).

2. The control method as claimed in claim 1, wherein, when the internal combustion engine is in operation, a filtering coefficient is determined on the basis of a first stored map according to the rotational speed of and according to the load on the internal combustion engine, next, a temperature setpoint is determined on the basis of a second stored map according to the rotational speed of and according to the load on the internal combustion engine, the load being the mass of air admitted or the torque at the output of the main shaft.

3. The control method as claimed in claim 1, wherein, when the internal combustion engine is not in operation, a filtering coefficient is determined (6) according to a predetermined value, and a temperature setpoint is next determined (7) so as to be equal to the temperature of the air admitted.

4. The control method as claimed in claim 1, wherein it is determined whether the state of the internal combustion engine has changed, and, if such is the case, a value of zero is stored as the value of the filtered filtering coefficient, and, if such is not the case, the stored value of the filtered filtering coefficient is retained.

5. The control method as claimed in claim 2, wherein it is determined whether the state of the internal combustion engine has changed, and, if such is the case, a value of zero is stored as the value of the filtered filtering coefficient, and, if such is not the case, the stored value of the filtered filtering coefficient is retained.

6. The control method as claimed in claim 3, wherein it is determined whether the state of the internal combustion engine has changed, and, if such is the case, a value of zero is stored as the value of the filtered filtering coefficient, and, if such is not the case, the stored value of the filtered filtering coefficient is retained.

* * * * *